US010889456B2

(12) United States Patent
Wick

(10) Patent No.: US 10,889,456 B2
(45) Date of Patent: Jan. 12, 2021

(54) HANDLING SYSTEM FOR HANDLING STACKABLE FLAT ELEMENTS

(71) Applicant: BOBST GRENCHEN AG, Grenchen (CH)

(72) Inventor: Stefan Wick, Oberbuchsiten (CH)

(73) Assignee: BOBST GRENCHEN AG, Grenchen (CH)

( * ) Notice: Subject to any disclaimer, the term of this patent is extended or adjusted under 35 U.S.C. 154(b) by 16 days.

(21) Appl. No.: 16/076,790

(22) PCT Filed: Feb. 9, 2017

(86) PCT No.: PCT/EP2017/025024

§ 371 (c)(1),
(2) Date: Aug. 9, 2018

(87) PCT Pub. No.: WO2017/137171

PCT Pub. Date: Aug. 17, 2017

(65) Prior Publication Data

US 2019/0047805 A1 Feb. 14, 2019

(30) Foreign Application Priority Data

Feb. 10, 2016 (EP) ..... 16020037

(51) Int. Cl.
*B65H 1/04* (2006.01)
*B65H 5/00* (2006.01)
(Continued)

(52) U.S. Cl.
CPC ..... *B65H 1/04* (2013.01); *B65H 5/006* (2013.01); *B65H 5/10* (2013.01); *B65H 5/14* (2013.01);
(Continued)

(58) Field of Classification Search
CPC .... B65H 1/04; B65H 2405/1412; B65H 1/00; B65H 2405/1111; B65H 2405/2405;
(Continued)

(56) References Cited

U.S. PATENT DOCUMENTS 2,381,430 A * 8/1945 Belluche ..... B65H 29/16 271/183
4,349,186 A * 9/1982 Nakamura ..... B65H 3/56 221/51
(Continued)

FOREIGN PATENT DOCUMENTS

DE 26 49 959 A1 5/1978
DE 3933625 C1 3/1991
(Continued)

OTHER PUBLICATIONS

International Search Report dated May 9, 2017 in corresponding PCT International Application No. PCT/EP2017/025024.
(Continued)

*Primary Examiner* — Thomas A Morrison
(74) *Attorney, Agent, or Firm* — Bookoff McAndrews, PLLC

(57) ABSTRACT

A handling system (100) for handling stackable flat elements, in particular carton elements. The system (100) includes a supporting table (102) on which at least an edge portion (303) of a stack (101) of flat elements is supportable, a clamping device (103) configured for clamping a first part (113) of the edge portion of the stack (101) to the supporting table (102), and a lifting device (104) configured for lifting a second part (114) of the stack (101) from the supporting table (102). The lifting device (104) and the clamping device (103) are arranged to the supporting table (102) such that the stack (101) is bendable by clamping the first part (113) of the stack (101) onto the supporting table (102) by the clamping device (103) and lifting the second part (114) of the stack
(Continued)

(101) from the supporting table (102) by the lifting device (104) at the same time such that the stack (101) is bent around a bending axis (109), wherein the bending axis (109) extends within a plane parallel to a supporting plane (112) of the supporting surface (111).

12 Claims, 2 Drawing Sheets

(51) Int. Cl.
*B65H 5/14* (2006.01)
*B65H 5/10* (2006.01)

(52) U.S. Cl.
CPC ..... *B65H 2301/4227* (2013.01); *B65H 2301/42242* (2013.01); *B65H 2301/51214* (2013.01); *B65H 2405/11161* (2013.01); *B65H 2515/30* (2013.01); *B65H 2701/1764* (2013.01)

(58) Field of Classification Search
CPC .... B65H 2405/1112; B65H 2405/1113; B65H 2405/11131; B65H 2405/1114; B65H 2405/11141; B65H 3/322
See application file for complete search history.

(56) References Cited

U.S. PATENT DOCUMENTS

| | | | | |
|---|---|---|---|---|
| 5,082,271 | A * | 1/1992 | Mohr | B65H 3/60 271/161 |
| 5,096,370 | A * | 3/1992 | Mohr | B65H 3/322 271/161 |
| 5,110,101 | A * | 5/1992 | Roth | B65H 45/109 225/104 |
| 2008/0191410 | A1* | 8/2008 | Shinohara | B65H 31/02 271/209 |

FOREIGN PATENT DOCUMENTS

| | | | |
|---|---|---|---|
| DE | 102005007874 | B3 | 4/2006 |
| GB | 2 121 012 | A | 12/1983 |
| JP | 2005-132565 | A | 5/2005 |

OTHER PUBLICATIONS

Written Opinion dated May 9, 2017 in corresponding PCT International Application No. PCT/EP2017/025024.
Notice of Opposition, in German, dated Jul. 22, 2020, in related EP Application No. EP17704165.4 (16 pages).

* cited by examiner

HANDLING SYSTEM FOR HANDLING STACKABLE FLAT ELEMENTS

CROSS-REFERENCE TO RELATED APPLICATIONS

The present application is a 35 U.S.C. §§ 371 national phase conversion of PCT/EP2017/025024, filed Feb. 9, 2017, which claims priority of European Patent Application No. 16020037.4, filed Feb. 10, 2016, the contents of which are incorporated by reference herein. The PCT International Application was published in the English language.

FIELD OF INVENTION

The present invention relates to a handling system for handling stackable flat elements, in particular carton elements, in particular during transporting a stack of flat elements to a processing device.

ART BACKGROUND

In the processing industry, raw material, such as flat carton elements, is delivered in large units. The large units of the carton elements have to be assembled into stacks comprising a predefined number of carton elements before the carton elements can be further processed in a processing unit, such as a printing machine for printing desired designs onto the carton elements.

The stacks comprise a desired quantity of cartons and are handled e.g. by complex robot arms or by manually controlled cranes, for example. During the manufacturing and finishing steps of the carton elements, stacks of carton elements have to be moved several times between the processing devices. The stack have to be treated very carefully in order to prevent damage to the sensitive carton elements. Hence, complex handling mechanisms have to be used to transport the stacks of cartoon elements between the processing devices.

SUMMARY OF THE INVENTION

There may be a need to provide a handling system for handling carton elements with a reduced risk of damaging the carton elements.

According to a first aspect of the present invention, a handling system for handling stackable flat elements, in particular carton elements, is presented. The handling system comprises a supporting table having a supporting surface onto which at least an edge portion of a stack of flat elements is supportable. The handling system further comprises a clamping device configured for clamping a first part of the stack to the supporting table and a lifting device configured for lifting a second part of the stack from the supporting table. The lifting device and the clamping device are arranged to the supporting table such that the stack is bendable by clamping the first part of the stack onto the supporting table by the clamping device and at the same time lifting the second part of the stack from the supporting table by the lifting device at the same time, such that the stack is bent around a bending axis, wherein the bending axis extends within a plane parallel to a supporting plane of the supporting surface.

According to a second aspect of the invention, a method for handling stackable flat elements, in particular carton elements, is presented. According to the method, at least an edge portion of a stack of flat elements is arranged onto a supporting surface of a supporting table. The stack is bendable by clamping a first part of the stack onto the supporting table by a clamping device and at the same time by lifting a second part of the stack from the supporting table by the lifting device, such that the stack is bent around a bending axis, wherein the bending axis extends within a plane parallel to a supporting plane of the supporting surface.

The flat elements as described above describe in general elements which are stackable and which comprise a larger width and length than the thickness. The stackable flat elements may include elements which can be stacked onto each other without any fixing means. The flat elements as described above denote elements which are stacked onto each other, wherein the resulting stack can be statically robust such that the stack does not need any holding systems for preventing tilting of the stack. More specifically, the flat elements may comprise a thickness which is less than 10 cm and a length and width of more than 10 cm. Specifically, in a preferred embodiment, the flat elements are non-folded cartons. However, other flat elements, such as sheet elements or other plate like elements can be handled by the handling system.

The stackable flat elements may be carton elements, such as of corrugated card board. The carton elements may be made of paper, cardboard, flexible materials such as sheets made of metal or plastic. The carton elements may be used for forming wrappers and packages.

In the present description, an edge portion of the stack denotes a portion of the stack between an edge and a center portion of the stack within a plane along which the length and the width of the stack are defined. The edge portion runs along an edge of the stack and may have an area within the plane of ⅓ to 1/10 times or less than the area of a center portion of the stack. The centre portion of a stack is surrounded by edge portions running along respective edges of the stack, wherein the edge portions define areas between the center portion and the respective edges of a stack. Specifically, the edge portion and the further edge portion which are described herein denote opposite edge portions of a stack.

The first part defines a section of the stack which contacts the clamping device when clamping the stack to the supporting table by the clamping device. Specifically, the first part is defined by a contact region of the clamping device with a first top sheet (flat element) of the stack. The second part defines a section of the stack which contacts the lifting device when it lifts the stack from the supporting table. Specifically, the second part is defined by a contact region of the lifting device with a second lower/bottom sheet (flat element) of the stack.

In a preferred embodiment, the first part and the second part are defined within the edge portion of the stack. The edge portion of the stack is initially bent by the clamping device and the lifting device, wherein by bending the edge portion, additionally, the center portion and the opposed further edge portion are bent around the bending axis as well, also if the clamping device and the lifting device acts onto the stack only at the edge portion.

The supporting table is configured for supporting at least an edge portion of the stack. The supporting table comprises in particular a supporting surface onto which the stack is partially arrangeable. If the clamping device does not clamp the stack to the supporting table, the stack may slide along the supporting surface until the stack is located at the defined position onto the supporting table. The supporting surface may form a flat and uncurved surface or a slightly curved surface. The supporting surface may be formed within a horizontal plane. Alternatively, the supporting surface may be inclined with respect to the horizontal plane. This means, that the normal of the supporting surface may have an angle to the normal of the horizontal plane of for example approximately 1° to approximately 45°.

The clamping device may comprise a clamping element, such as a clamping bar extending along the first part of the stack. Alternatively, the clamping element is a stamp which is formed to clamp the first part of the stack against the supporting table. The clamping device may be movable along a vertical direction and may move along the clamping direction from a position spaced apart from the supporting table to a position closer to the supporting table for thereby clamping the first part of the stack between the clamping device and the supporting table.

The lifting device may comprise a lifting element, such as a lifting platform, a lifting lever or a lifting stamp, extending along the second part of the stack. The lifting device may be mounted to the supporting table and may be integrated within the supporting table in such a way that the lifting lever forms a flat and homogeneous surface with the supporting surface, wherein the lifting element may come up from the supporting surface along the lifting direction for lifting the second part of the stack. The lifting direction defines a direction having a vertical component, wherein the lifting element extends along the lifting direction when coming up from the supporting surface.

Before bending the stack of flat elements, the stack rests on the supporting surface of the supporting table. The supporting surface defines for example the supporting plane. Hence, if the stack of flat elements is arranged onto the supporting surface, each of the flat elements is arranged within a respective plane which is spaced apart from and parallel to the supporting plane. Hence, if the stack is unbent and has only a general two dimensional extension within the respective plane, the stack and the flat elements, respectively, are easy to deform around a deforming axis which extends within the respective plane. This deforming around the deforming axis is not desired, because it causes unwanted deforming of the stack during handling of the stack.

In the present invention, the stack of the elements is bent such that the stack and each flat element, respectively, is bent by the lifting device and the clamping device around a bending axis. Metaphorically speaking, a cross-section of the stack has a U-shape. The bending by cooperation of the lifting device and the clamping device describes bending which causes an elastic and non-plastic deformation of the stack. Thus, the bending by the lifting device and the clamping device does not include folding or cracking of the stack and the flat elements, respectively. The bent cross-section may be described in an abstract manner by a bending line, wherein the bending axis runs through the centers of curvature of the bending lines of respective cross sections of the stack.

Unwanted deforming of the stack around a deforming axis (which extends within the plane and differs (e.g. being perpendicular) to the above described bending axis) is avoided because the stack is stiffer against deformation around the deformation axis due to having the U-shaped cross-section. Hence, handling the stack in a bent and stiffer state reduces the risk of damaging the flat elements because the risk of unintentional folding or cracking around a deformation axis is reduced.

In order to achieve the above effect, a slight bending of the stack around the bending axis may be sufficient. For example, while the first part of the stack is clamped to the supporting table by the clamping device, the second part of the stack is lifted by the lifting device with respect to the first part by a vertical distance between the first part and the second part of approximately 5 cm to approximately 40 cm, for example.

According to an exemplary embodiment of the present invention, the supporting table is movable along a moving direction having a horizontal component between a first position and a second position. The clamping device is configured for clamping the stack to the supporting table during movement of the supporting table between the first position and the second position. For example, the supporting table may comprise roller elements for moving along a moving direction. For example, the supporting table may be arranged onto a guiding rail, for example. In an exemplary embodiment, the clamping device and the lifting device are mounted to the supporting table such that the clamping device and the lifting device move together with the supporting table along the moving direction.

For example at the first position, the stack is arranged onto the supporting surface of the supporting table. Next, the clamping device and the lifting device fix the stack. In this fixed and bent state, the supporting table moves along the moving direction to a desired second position, where the clamping device and the lifting device release the stack such that the stack is available for further processing or transportation away from the supporting table. During the transportation between the first position and the second position, the stack is in a bent state and is more robust and stiffer against undesired deformation around the deformation axis.

According to a further exemplary embodiment, the lifting device comprises at least one lifting element (as described above) which is movable along a lifting direction having at least one vertical component. In a further exemplary embodiment, the lifting element is mounted to the supporting table such that the lifting element is extendible from the supporting surface of the supporting table, onto which supporting surface the stack is arrangeable. The lifting element may be driven hydraulically, pneumatically or by an electronic motor.

According to a further exemplary embodiment, the lifting element is configured to be extendible in a telescopic manner. Hence, the lifting element may be formed as a telescopic rod which is for example installed into the supporting table. Hence, in order to lift the second part of the stack, the telescopic rods may be extendable along the lifting direction.

According to a further exemplary embodiment, the lifting element is configured to be extendible by being pivoted around a pivoting axis. For example, the lifting element is formed as a lever which is mounted pivotable to the supporting table. Hence, in order to lift the second part of the stack, the pivotable lever may be pivoted around a pivot axis, such that a part of the lever spaced apart from the pivot axis lifts along the lifting direction.

A first end of the pivotable lever is fixed pivotably to the supporting table. An opposed second end of the pivotable lever defines a free end which lifts along the lifting direction and thereby contacts the second part of the stack. In a preferred embodiment, the first end is located at a center section of the supporting table and the opposed second end of the lever is located more to an edge section of the supporting table (which edge section surrounds the center section of the supporting table). Hence, when pivoting the lever around the pivot axis, the free second end of the lever lifts with a larger distance from the supporting table than would other sections of the lever such that an inclined lifting surface is formed. The inclined lifting surface passive smooth and gentle bending of the first part of the stack.

According to a further exemplary embodiment, the lifting device comprises at least one further lifting element which is movable along the lifting direction. It has at least one vertical component, wherein the further lifting element is spaced apart from the lifting element.

In particular, according to a further exemplary embodiment, the clamping device is arranged between the lifting element and the further lifting element. Hence, the clamping device may for example clamp a central part (first part) of the stack to the supporting table, wherein an edge part (second part) of the stack and an further edge part (further second part) of the stack, which is arranged at an opposite side of the stack with respect to the edge part, is lifted by the respective lifting elements. The stack thereby is bent, wherein the bending axis is generated in the region of the central part, so that the stack forms a U-shape.

According to an exemplary embodiment, the clamping device comprises at least one clamping element (as described above) which is movable along a clamping direction having at least one vertical component. In an exemplary embodiment, the clamping element forms a stamp element for pressing and thereby clamping the stack to the supporting table. In a further exemplary embodiment, the clamping element is mounted to the supporting table in such a way that the clamping element is movable along the clamping direction to the supporting surface of the supporting table onto which supporting surface the stack is arrangeable. The clamping element may be driven hydraulically, pneumatically or by an electronic motor.

According to an exemplary embodiment, the clamping device comprises at least one further clamping element which is movable along the clamping direction having at least one vertical component, wherein the further clamping element is spaced apart from the clamping element.

In an exemplary embodiment, the lifting device is arranged between the clamping element and the further clamping element. Hence, the lifting device may for example lift a central part (second section) of the stack away from the supporting table, wherein an edge part (first section) of the stack and a further edge part (further first section) of the stack, which is arranged at an opposite side of the stack with respect to the edge part, is clamped (pressed) to the supporting table by the respective clamping elements. The stack is again bent, wherein the bending axis is generated in the region of the central part, so that the stack forms an upside-down U-shape.

According to an exemplary embodiment, the handling system further comprises a transport device. The transport device comprises a supporting platform onto which at least a further edge portion of the stack is supportable, wherein the transport device is configured for clamping the further edge portion of the stack to the supporting platform. The transport device is movable for transporting the stack to the supporting table such that the edge portion of the stack is arrangeable onto the supporting table.

The above described transport system clamps the further edge portion of the stack by the hold down element to the supporting platform. The rest of the stack, which is not clamped by the hold down element, is arranged for example onto a carrier. By moving the transport device along a desired direction, for example perpendicular to the moving direction of the supporting table, the edge portion of the stack slips away from the carrier and can be slid onto the supporting surface of the supporting table. The carrier may therefore be higher than the supporting surface in order to provide a simple handover by sliding the edge portion from the carrier to the supporting surface.

According to an exemplary embodiment, the handling system further comprises a receiving section at which the stack is receivable. The receiving section is arranged below the supporting table and the transport device. The transport device is further movable for transporting the stack to the supporting table such that the further edge portion of the stack is arrangeable above the receiving section. The transport device is configured for releasing the further edge portion of the stack and for moving away from the receiving section such that the further edge falls down to the receiving section while the first part of the stack is clamped to the supporting table by the clamping device and the second part of the stack is lifted by the lifting device.

The receiving section may define for example a section from which the stack and the single flat elements of the stack are further processed, for example by a processing device. The processing device may be a device for processing, laminating, coating or printing of the flat elements.

For example, after the transport device pushes at least the edge portion of the stack onto the supporting surface, the transport device releases the further edge portion. The further edge portion is thereby located above the receiving section. After the transport device moves away, the further edge portion falls onto the receiving section. Alternatively, the supporting table, to which the edge portion of the stack is fixed by the clamping device and the lifting device, may move away from the transport device so that the further edge portion slips from the support platform of the transporting device.

Because the stack is bent during the fall onto the receiving section, the stack is still and robust and stiff, preventing an undesired deformation of the stack. Additionally, after the further edge portion is located onto the receiving section, the supporting table may move along a moving direction, for example from the second position to the first position, such that the location of the further edge portion onto the receiving section may be adjusted by moving the supporting table. During movement of the supporting table, the stack is still bent by the clamping device and the lifting device. Therefore, the stack is stiff and robust enough that undesired deformation during the movement of the supporting table is also prevented.

If the desired location of the further edge onto the receiving section is reached, the lifting device and the clamping device release the edge portion of the stack and in a next step, the supporting table moves away from the receiving section. The edge portion falls also onto the receiving section and the whole stack is thereby arranged in the receiving section for further proceeding.

According to third aspect of the invention, a handling system is provided for handling a stack of flat elements. The stack comprises upper and lower faces and a proximal side face mutually opposing a distal side face, the system comprising a support surface arranged to support the lower face of the stack in a region adjacent the proximal side face. The system further comprises a clamp arranged to clamp the upper surface of the stack in a region adjacent the proximal side face against the support surface. The system is further arranged to bend the stack which causes the stack to become stiffer, thereby at least partially counteracting the deflection under gravity of the stack in the area adjacent the distal side face relative to the area adjacent the proximal side face. In this aspect of the invention, the bending of the stack may be achieved in a number of ways. For example, the act of clamping the stack against the support surface may itself cause the stack to bend, where the support surface is formed with a profile that corresponds to the shape of the stack when bent. Thus, the force applied by the clamp may be used to force the stack to bend, conforming to the profile of the support surface. Alternatively, the stack may be bent by one or more a separate actuators, as described below. It will be understood that other features and advantages described with reference to other embodiments according to other aspects of the invention may also be used to advantage with respect to embodiments according to this third aspect of the invention.

Embodiments of the invention have been described with reference to different subject matters. In particular, some embodiments have been described with reference to apparatus type claims whereas other embodiments have been described with reference to method type claims. However, a person skilled in the art will gather from the above and the following description that, unless otherwise notified, in addition to any combination of features belonging to one type of subject matter also any combination between features relating to different subject matters, in particular between features of the apparatus type claims and features of the method type claims are disclosed herein.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION OF EXEMPLARY EMBODIMENTS

Figure 1:
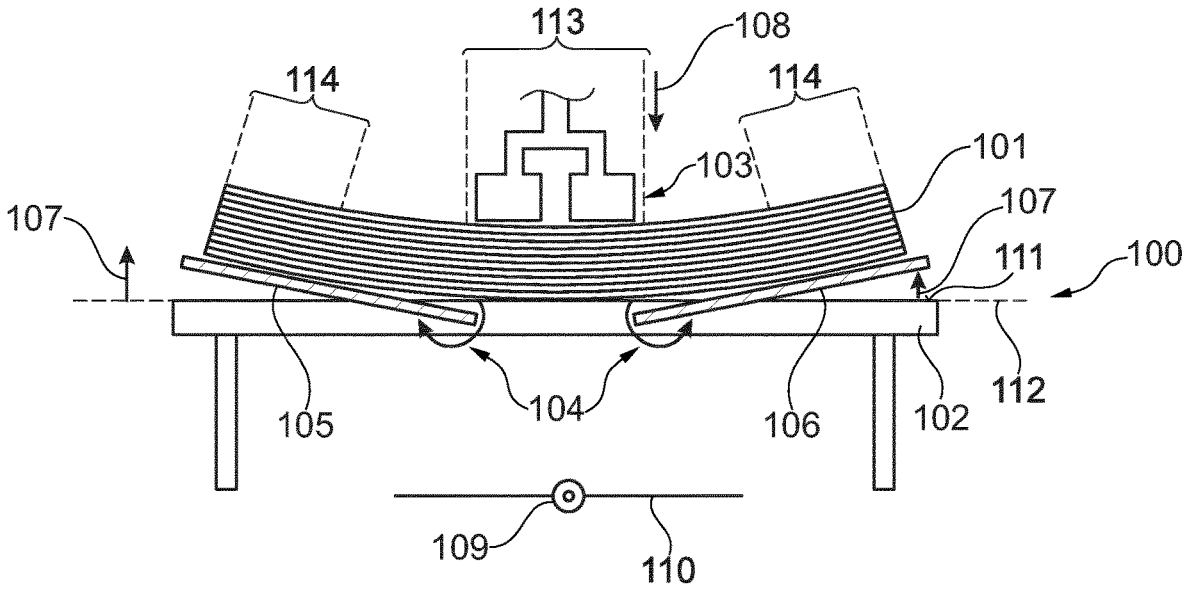
FIG. 1 shows an exemplary embodiment of the handling system, wherein a stack of flat elements is bent by a clamping device and a lifting device.

The illustrations in the drawings are schematic. It is noted that in different Figures, similar or identical elements are provided with the same reference signs.

Figure 2:
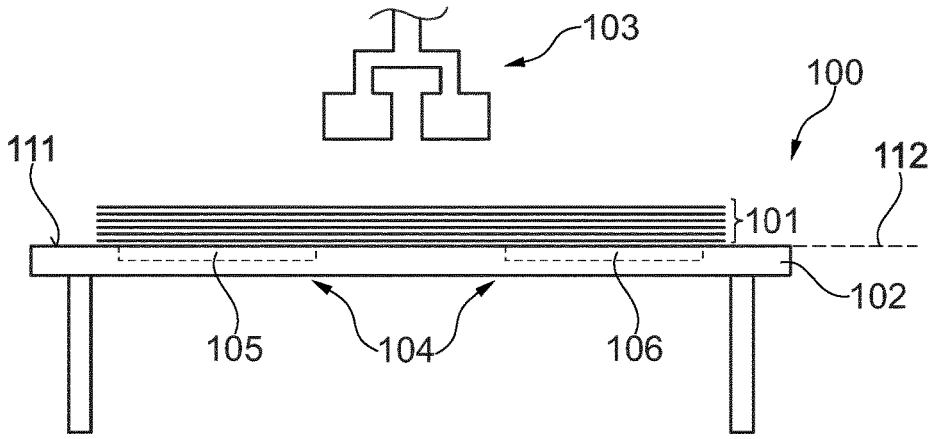
FIG. 2 shows the handling system of FIG. 1, wherein the stack of flat elements is not bent by the clamping device and the lifting device.

FIG. 1 and FIG. 2 show a handling system 100 for handling stackable flat elements, in particular carton elements, according to an exemplary embodiment of the present invention. The handling system 100 comprises a supporting table 102 onto which at least an edge portion 303 of a stack 101 of flat elements is supportable, a clamping device 103 configured for clamping a first part 113 of the edge portion of the stack 101 to the supporting table 102, and a lifting device 104 configured for lifting a second part 114 of the stack 101 from the supporting table 102. The lifting device 104 and the clamping device 103 are arranged to the supporting table 102 such that the stack 101 is bendable by clamping the first part 113 of the stack 101 onto the supporting table 102 by the clamping device 103 and lifting the second part 114 of the stack 101 from the supporting table 102 by the lifting device 104 at the same time that the stack 101 is bent around a bending axis 109, wherein the bending axis 109 extends within a plane parallel to a supporting plane 112 of the supporting surface 111.

The flat elements forming the stack 101 may be non-folded cartons. The first part 113 of the stack 101 defines a section of the stack 101 which contacts the clamping device 103 when the device 103 clamps the stack 101 to the supporting table 102. Specifically, the first part 113 is defined by a contact region of the clamping device 103 clamping on region a first top sheet (flat element) of the stack 101. The second part 114 defines a section of the stack 101 which contacts the lifting device 104 during lifting of the stack 101 from the supporting table 102 by the lifting device 104. Specifically, the second part 114 is defined by a contact region of the lifting device 104 with a second lower/bottom sheet (flat element) of the stack 101. In a preferred embodiment, the first part 113 and the second part 114 are defined within the edge portion 303 of the stack 101 (see FIG. 3). The edge portion 303 of the stack is initially bent by the clamping device 103 and the lifting device 104. By bending of the edge portion 303, additionally the center portion 302 and the opposed further edge portion 304 are bent around the bending axis 109 as well, also if the clamping device 103 and the lifting device 104 act on the stack 101 only at the edge portion 303.

The supporting table 102 supports at least the edge portion 303 of the stack 101. The supporting table 102 comprises in particular the supporting surface 111 onto which the stack 101 is partially arranged. If the clamping device 103 does not clamp the stack 101 to the supporting table 102 (see FIG. 2), the stack 101 may slide along the supporting surface 111 until the stack 101 is located at the defined position onto the supporting table 102. The supporting surface 111 may be formed within a supporting plane 112, e.g. a horizontal plane. Alternatively, the supporting surface 111 and hence the supporting plane 112 may be inclined with respect to the horizontal plane. This means, that the normal of the supporting surface 111 and hence the supporting plane 112 may have an angle to the normal of the horizontal plane of for example approximately 1° to approximately 45°.

The clamping device 103 may comprises a clamping element, such as one or more stamps, as shown in the FIG. 1 and FIG. 2, which is configured to clamp the first part 113 of the stack 101 against the supporting table 102. The clamping device 103 is movable along a vertical direction and may move along the vertical clamping direction 108 from a position spaced apart from the supporting table 102 to a position closer to the supporting table 102 for thereby clamping the first part 113 of the stack 101 between the clamping device 103 and the supporting table 102 as shown in FIG. 1.

The lifting device 104 comprises two lifting elements 105, 106, which are mounted to the supporting table 102 and are integrated with the supporting table 102 such that the lifting elements 105, 106 form a flat and homogeneous surface with the supporting surface (see FIG. 1). The elements 105, 106 rise from the supporting surface 111 along the lifting direction 107 to lift the second part 114 of the stack 101. The lifting direction 107 defines a direction having a vertical component, wherein the lifting elements 105, 106 extends along the lifting direction 107 when rising from the supporting surface 111.

Before bending at the stack 101 of flat elements, the stack 101 rests on the supporting surface 111 of the supporting table 102 (see FIG. 2). The supporting surface 111 defines for example the supporting plane 112. Hence, if the stack 101 of flat elements is arranged on the supporting surface 111, each of the flat elements is arranged within a plane which is spaced apart from the supporting plane 112 and parallel to the supporting plane 112. Hence, if the stack 101 is unbent and has only a general two dimensional extension within the respective plane (see FIG. 2), the stack 101 and the flat elements, respectively, are easy to be deformed around a deforming axis 110 which extends within the respective plane.

As can be seen in FIG. 1, the stack 101 of the flat elements is bent such that the stack 101 and each flat element, respectively, are bent by the lifting device 104 and the clamping device 103 around the bending axis 109. As seen in FIG. 1, the bent stack 101 forms a U-shape. The bending by the lifting device 104 and the clamping device 103 describes bending which causes an elastic and non-plastic deformation of the stack 101. In other words, the bending by the lifting device 104 and the clamping device 103 does not include a folding or cracking of the stack 101 and the flat elements, respectively.

Deforming of the stack 101 around a deforming axis 110 extending within the plane 112 and differing (e.g. being perpendicular) from the above described bending axis 109 is avoided because the stack 101 is stiffer against the deformation around the deformation axis due to the U-shaped cross-section. Hence, handling the stack 101 in a bent and stiffer state reduces the risk of damaging the flat elements by reducing the risk of unintentional folding or cracking around a deformation axis.

In the exemplary embodiment, the lifting device 104 comprises in the exemplary embodiment a lifting element 105 and at least one further lifting element 106, both being movable along the lifting direction 107 which has at least one vertical component, wherein the further lifting element 106 is spaced apart from the lifting element 105.

The clamping device 103 is arranged between the lifting element 105 and the further lifting element 106. Hence, the clamping device 103 may for example clamp a central part (first section 113) of the stack 101 to the supporting table 102, wherein an edge part (second part 114) of the stack 101 and an further edge part (further second part 114) of the stack 101, which is arranged at an opposite side of the stack 101 with respect to the edge part, is lifted by the respective lifting elements 105, 106. The stack 101 is thereby bent, wherein the bending axis 109 is generated in the region of the central part 113, so that the stack 101 forms a generally U-shape.

The lifting elements 105, 106 are configured to be extendible by being pivoted around a pivot axis (see arrows in FIG. 1). For example, each lifting element 105, 106 is formed as a lever which is mounted pivotably to the supporting table 102. In order to lift the second part 114 of the stack 101, the pivotable lever may be pivoted around a pivoting axis such that a part of the lever spaced apart from the pivoting axis lifts along the lifting direction 109. FIG. 1 shows a first end of the pivotable lever fixed pivotably to the supporting table 102, and an opposed second free end of the pivotable lever defines a free end which lifts along the lifting direction and thereby contacts the second part 114 of the stack 101. The first end of the lever is located at a center section of the supporting table 102 and the opposite second free end of the lever is located more toward an edge section of the supporting table 102 (which edge section surrounds the center section of the supporting table 102). Hence, during pivoting of the lever around the pivot axis, the free second end of the lever lifts over a larger distance from the supporting table 102 than other sections of the lever forming an inclined lifting surface. The inclined lifting surface makes possible a smooth and gentle bending of the first part 113 of the stack 101.

Figure 3:
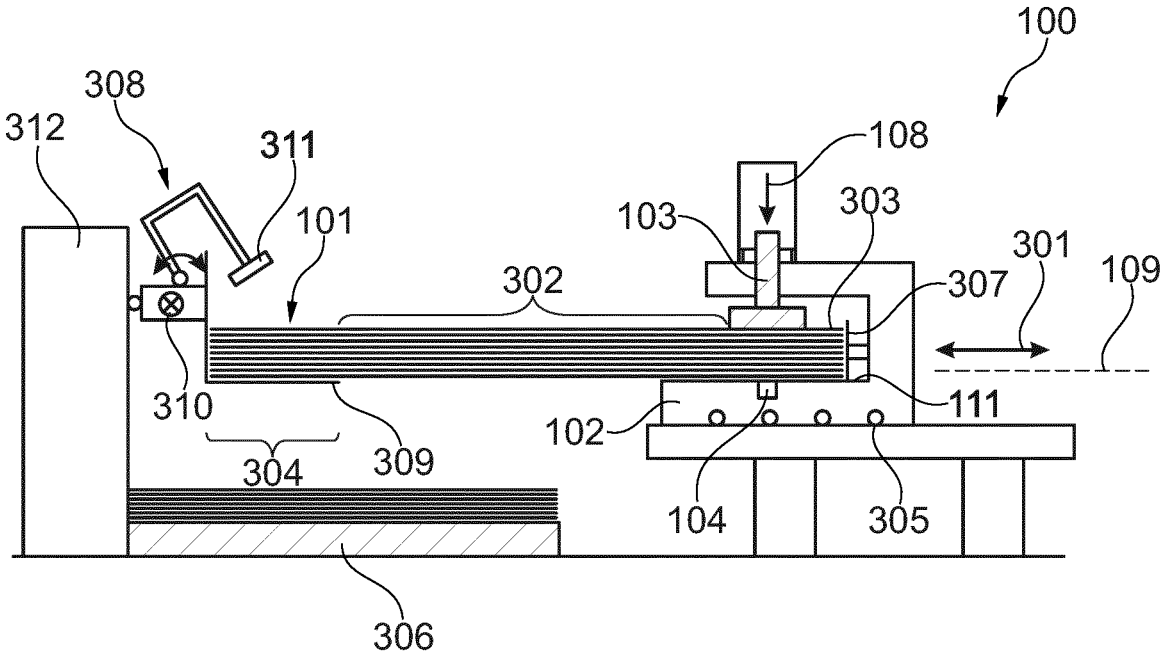
FIG. 3 shows an exemplary embodiment of the handling system additionally comprising a transport device and a receiving section.

FIG. 3 shows an exemplary embodiment of the handling system further comprising an additional a transport device 308 and a receiving section 306.

The supporting table 102 is movable along a moving direction 301 having a horizontal component, between a first position and a second position, wherein the clamping device 103 is configured for clamping the stack 101 to the supporting table 102 during movement of the supporting table 102 between the first position and the second position. The supporting table 102 comprises roller/wheel elements 305 for moving the table along the moving direction 301. For example, the supporting table 102 may be arranged on a guiding rail, for example. In the illustrated embodiment, the clamping device 103 and the lifting device 104 are mounted to the supporting table 102 such that the clamping device 103 and the lifting device 104 move together with the supporting table 102 along the moving direction 301.

For example at the first position (shown in FIG. 3), the stack 101 is arranged on the supporting surface 111 of the supporting table. Next, the clamping device 103 and the lifting device 104 fix the stack 101. In this fixed and bent state, the supporting table 102 moves along the moving direction 301 to a desired second position (e.g. moves to the right in FIG. 3), where the clamping device 103 and the lifting device 104 release the stack 101 such that the stack 101 is available for further processing or transportation away from the supporting table 102. During the transportation between the first position and the second position, the stack 101 is in a bent state and is more robust and stiffer against an undesired deformation around the deformation axis.

The handling system 100 further comprises the transport device 308, comprising a supporting platform 309 onto which at least a further edge portion 304 of the stack 101 is supportable, wherein the transport device 308 is configured for clamping the further edge portion 304 of the stack 101 to the supporting platform 309 by a hold-down element. The transport device 308 is movable along a transport direction 310 for transporting the stack 101 to the supporting table 102 such that the edge portion 303 of the stack 101 is arrangeable on the supporting table 102.

The edge portion 303 of the stack 101 denotes a portion of the stack 101 between an edge portion and a center portion 302 of the stack 101 within a plane along which the length and the width of the stack 101 are defined. The edge portion 303 runs along an edge of the stack 101 and may have an area within the plane of ⅓ to 1/10 times or less than the area of a center portion of the stack 101. The center portion 302 of a stack 101 is surrounded by edge portions 303, 304 running along respective edges of the stack 101, wherein the edge portions 303, 304 define areas between the center portion 302 and the respective edges of a stack 101. Specifically, the edge portion 303 and the further edge portion 304 which are described herein denotes opposing edge portions 303, 304 of the stack 101.

In a preferred embodiment, the first part 113 and the second part 114 are defined within the edge portion 303 of the stack 101. The edge portion 303 of the stack 101 is initially bent by the clamping device 103 and the lifting device 104. By bending the edge portion 303, additionally the center portion 302 and the opposite further edge portion 304 are bent around the bending axis 109 as well, also if the clamping device 103 and the lifting device 104 acts onto the stack 101 only at the edge portion 303.

The further edge portion 304 of the stack 101 is clamped by the hold down element 311 to the supporting platform 309. The rest of the stack 101 which is not clamped by the hold down element 311 is arranged for example on a carrier (not shown), for example. By moving the transport device 308 along a desired direction, for example perpendicular to the moving direction 301 of the supporting table 102, the edge portion 303 of the stack 101 slips away from the carrier and can be slid onto the supporting surface 111 of the supporting table 102.

A receiving section 306 is arranged below the supporting table 102 and the transport device 308. The receiving section 306 may define for example a section from which the stack 101 and the single flat elements of the stack 101 are further processed, for example by a processing device 312. The processing device 312 may be a device for processing, laminating, coating or printing of the flat elements.

The transport device 308 along a transport direction 310 is further movable for transporting the stack 101 to the supporting table such that the further edge portion 304 of the stack 101 may be arranged above the receiving section 306. The transport device 308 is configured for releasing the further edge portion 304 of the stack 101 and for moving away from the receiving section 306 such that the further edge 304 falls down to the receiving section 306 while the first part 113 of the stack 101 is clamped to the supporting table 102 by the clamping device 103 and the second part 114 of the stack 101 is lifted by the lifting device 104.

For example, after the transport device 308 pushes at least the edge portion 303 of the stack 101 onto the supporting surface 111, the transport device 308 releases the further edge portion 304. The further edge portion 304 is thereby located above the receiving section 306. After the transport device 308 moves away, the further edge portion 304 falls onto the receiving section 306. Alternatively, the supporting table 102, to which the edge portion 303 of the stack 101 is fixed by the clamping device 103 and the lifting device 104, may move away from the transport device 308 so that the further edge portion 304 slips from the support platform 309 of the transporting device 308.

Because the stack 101 is bent during its fall onto the receiving section 306, the stack 101 is still and robust and stiff, such that a undesired deformation of the stack 101 is prevented. Additionally, after the further edge portion 303 is located onto the receiving section 306, the supporting table 102 may move along a moving direction 301 for example from the second position to the first position such that the location of the further edge portion 304 laying on the receiving section 306 may be adjusted by moving the supporting table 102. During the movement of the supporting table 102, the stack 101 is still bent by the clamping device 103 and the lifting device 104. As a result, the stack 101 is stiff and robust enough such that also undesired deformation during the movement of the supporting table 102 is prevented.

If the desired location of the further edge portion 304 on the receiving section 306 is reached, the lifting device 104 and the clamping device 103 release the edge portion 303 of the stack 101. In a next step, the supporting table 102 moves away from the receiving section 306. Furthermore, a pushing platform 307 may push the stack 101 from the supporting table 102. The edge portion 303 then falls onto the receiving section 306 and the whole stack 101 is thereby arranged in the receiving section 306 for a further proceeding.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

REFERENCE SIGNS

100 handling system
101 stack
102 supporting table
103 clamping device
104 lifting device
105 lifting element
106 further lifting element
107 lifting direction
108 clamping direction
109 bending axis
110 deforming axis
111 supporting surface
112 supporting plane
113 first part
114 second part
301 moving direction
302 central portion
303 edge portion
304 further edge portion
305 wheel element
306 receiving section
307 pushing platform
308 transport device
309 supporting platform
310 moving direction of transporting device
311 hold down element
312 processing device

The invention claimed is:

1. A handling system for handling a stack of flat elements, the handling system comprising:

a supporting table comprising a supporting surface configured to support at least a first edge portion of the stack;

a clamping device located and configured for clamping a first part of the stack to the supporting table; and a lifting device configured to lift a second part of the stack from the supporting table;

wherein the first part is adjacent the first edge portion, and the second part is adjacent a third edge portion of the stack, the third edge portion being transverse to the first edge portion;

the lifting device and the clamping device are arranged at the supporting table such that the stack is bendable by clamping of the first part of the stack onto the supporting table by the clamping device and by lifting the second part of the stack from the supporting table by the lifting device at a same time, such that the stack is bent around a bending axis so that the third edge portion is lifted relative to the first edge portion;

the bending axis extends within a plane parallel to a supporting plane of the supporting surface;

a transport device comprising a supporting platform configured to support at least a second edge portion of the stack transverse to the third edge portion, the transport device is configured to clamp the second edge portion of the stack to the supporting platform;

the transport device is configured to be moved to transport the stack to the supporting table, such that the first edge portion of the stack is positioned on the supporting table, the lifting device comprises a first lifting element configured to move along a lifting direction having at least one vertical component for lifting a part of the stack, and the first lifting element is mounted to the supporting table such that the first lifting element is extendible from the supporting surface of the supporting table on which the stack is arrangeable.

2. A handling system according to claim 1, wherein the supporting table is movable along a moving direction having a horizontal component, between a first position and a second position; and the clamping device is configured for clamping the stack to the supporting table during a movement of the supporting table between the first position and the second position.

3. A handling system according to claim 1, wherein the first lifting element is configured to be extendible by being pivoted around a pivoting axis.

4. A handling system according to claim 1, wherein the lifting device comprises at least a second lifting element configured to be moved along the lifting direction, the lifting direction having at least one vertical component; and the second lifting element is spaced apart from the first lifting element.

5. A handling system according to claim 4, wherein the clamping device is arranged between the first lifting element and the second lifting element.

6. A handling system according to claim 1, wherein the clamping device comprises at least one clamping element, which is movable along a clamping direction having at least one vertical component.

7. A handling system according to claim 6, wherein the at least one clamping element forms a stamp element configured for clamping the stack to the supporting table.

8. A handling system according to claim 6, wherein the at least one clamping element is a first clamping element, the clamping device comprises a second clamping element being movable along the clamping direction in at least one vertical component; and the second clamping element is spaced apart from the first clamping element.

9. A handling system according to claim 8, wherein the lifting device is arranged between the first clamping element and the second clamping element.

10. A handling system according to claim 1, further comprising:

a receiving section at which the stack is receivable;

the receiving section is arranged below the supporting table and the transport device;

the transport device is configured to be moved to transport the stack to the supporting table such that the second edge portion of the stack is arranged above the receiving section; and the transport device is configured for releasing the second edge portion of the stack and for moving away from the receiving section such that the second edge portion falls down to the receiving section while the first part of the stack is clamped to the supporting table by the clamping device and the second part of the stack is lifted by the lifting device.

11. A method for handling a stack of flat elements, the method comprising:

arranging at least a first edge portion of the stack on a supporting surface of a supporting table by:

supporting at least a second edge portion of the stack on a supporting platform of a transport device that clamps the second edge portion of the stack to the supporting platform, and moving the transport device to transport the stack to the supporting table, such that the first edge portion of the stack is positioned on the supporting table;

bending the stack by clamping a first part of the stack on the supporting table by a clamping device and lifting a second part of the stack from the supporting table by a lifting device at a same time, such that a third edge portion of the stack is lifted relative to the first edge portion and such that the stack is bent around a bending axis;

wherein the first part is adjacent the first edge portion, and the second part is adjacent the third edge portion, and the third edge portion is transverse to the first edge portion and to the second edge portion.

12. A handling system for handling a stack of flat elements, the stack comprising upper and lower faces and a proximal side face opposite a distal side face, the handling system comprising:

a support surface arranged and configured to support a first edge portion of the lower face of the stack in a first region adjacent the proximal side face;

a clamp arranged to clamp the upper face of the stack in a second region adjacent the proximal side face and against the support surface;

the system being further arranged to bend the stack for causing the stack to become stiffer such that a third edge portion transverse to the first edge portion is lifted relative to the first edge portion, thereby at least partially counteracting deflection under gravity of the stack in an area adjacent the distal side face relative to an area adjacent the proximal side face;

the system further comprising:

a transport device comprising a supporting platform configured to support at least a second edge portion of the stack transverse to the third edge portion, and the transport device is configured to clamp the second edge portion of the stack to the supporting platform; and the transport device is configured to be moved to transport the stack to a supporting table having the support surface, such that the first edge portion of the stack is positioned on the supporting table.

* * * * *